US009200493B1

(12) United States Patent
Lugo

(10) Patent No.: US 9,200,493 B1
(45) Date of Patent: Dec. 1, 2015

(54) APPARATUS FOR THE SHEARING OF PIPE THROUGH THE USE OF SHAPE CHARGES

(71) Applicant: Marío R. Lugo, Houston, TX (US)

(72) Inventor: Marío R. Lugo, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 177 days.

(21) Appl. No.: 14/152,550

(22) Filed: Jan. 10, 2014

(51) Int. Cl.

| | |
|---|---|
| ***E21B 7/12*** | (2006.01) |
| ***E21B 29/12*** | (2006.01) |
| ***E21B 29/02*** | (2006.01) |
| ***E21B 33/064*** | (2006.01) |

(52) U.S. Cl.
CPC ..... *E21B 29/12* (2013.01); *E21B 29/02* (2013.01); *E21B 33/064* (2013.01)

(58) Field of Classification Search
CPC ..... E21B 29/02; E21B 29/12
USPC ..... 166/363, 297, 55
See application file for complete search history.

(56) References Cited

U.S. PATENT DOCUMENTS

| | | | | |
|---|---|---|---|---|
| 3,561,526 | A | 2/1971 | Williams, Jr. et al. | |
| 4,046,191 | A * | 9/1977 | Neath | 166/352 |
| 4,132,267 | A | 1/1979 | Jones | |
| 4,323,117 | A * | 4/1982 | Pierce | 166/55 |
| 4,724,105 | A * | 2/1988 | Owen | 264/3.1 |
| 4,813,495 | A * | 3/1989 | Leach | 175/6 |
| 5,777,257 | A * | 7/1998 | Kenny | 102/312 |
| 6,173,770 | B1 | 1/2001 | Morrill | |
| 6,230,627 | B1 * | 5/2001 | Poe | 102/307 |
| 6,244,336 | B1 | 6/2001 | Kachich | |
| 6,273,193 | B1 * | 8/2001 | Hermann et al. | 166/359 |
| 6,460,463 | B1 * | 10/2002 | Parrott et al. | 102/312 |
| 6,675,896 | B2 * | 1/2004 | George | 166/297 |
| 7,234,530 | B2 | 6/2007 | Gass | |
| 7,661,367 | B2 * | 2/2010 | Yang et al. | 102/306 |
| 7,779,760 | B2 * | 8/2010 | Konig | 102/476 |
| 8,302,534 | B2 * | 11/2012 | Yang et al. | 102/306 |
| 8,443,880 | B1 | 5/2013 | Jahnke | |
| 8,448,915 | B2 | 5/2013 | Baugh | |
| 8,561,683 | B2 * | 10/2013 | Wood et al. | 166/63 |
| 8,567,490 | B2 | 10/2013 | Van Winkle | |
| 8,893,801 | B2 * | 11/2014 | Hales et al. | 166/338 |
| 9,038,713 | B1 * | 5/2015 | Bell et al. | 166/55.7 |
| 2010/0147519 | A1 * | 6/2010 | Goodman | 166/297 |
| 2013/0220631 | A1 * | 8/2013 | Wilie | E21B 29/02 166/363 |

* cited by examiner

*Primary Examiner* — Matthew R Buck
*Assistant Examiner* — Aaron Lembo
(74) *Attorney, Agent, or Firm* — Egbert Law Offices, PLLC

(57) ABSTRACT

An apparatus for the shearing of pipe in a subsea environment has a housing with an interior passageway suitable for allowing a pipe to extend therethrough, a shell positioned in the interior passageway of the housing, and a shape charge positioned in the shell so as to be directed toward an outer diameter of the pipe. The shaped charge includes a plurality of shape charges positioned in the shell so as to be directed to the outer diameter of the pipe. The plurality of shape charges extend radially within the shell. The plurality of shape charges are positioned in a common horizontal plane. The shell can be movable between a first position in which the shape charge is spaced from the pipe and a second position in which the shape charge bears against an outer diameter of the pipe.

14 Claims, 3 Drawing Sheets

APPARATUS FOR THE SHEARING OF PIPE THROUGH THE USE OF SHAPE CHARGES

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to subsea drilling and production activities. More particularly, the present invention relates to blowout preventers and other devices in which subsea pipe is closed and/or sheared. Additionally, the present invention relates to shape charges for the cutting a pipe.

2. Description of Related Art Including Information Disclosed Under 37 CFR 1.97 and 37 CFR 1.98.

In the operation a blowout preventers in deep water operations, is often necessary to shear pipe within the wellbore and the seal the wellbore to protect the environment in emergency situations when an obstruction is in the wellbore. Shear rams in blowout preventers are designed to cut the pipe in emergency situations and allow the bore to be closed so as to secure the well against unintended discharges of hydrocarbons into the environment. Blind shear rams are designed to both shear the pipe and to seal off the wellbore in a single movement.

Generally, in recent years, drill pipe has become larger in diameter, greater and wall thickness, and a higher yield strength. As such, such drill pipe becomes more difficult to shear. In the past, accumulators have been used as a source of power to carry out the shearing. In many circumstances, the accumulator pressure is it not sufficiently available so as to properly carry out the shearing action. The combination of such difficult pipe and inadequate pressures has resulted in the circumstance in which some pipes cannot be sheared.

It is known that the pipe must be sheared when the maximum anticipated pressure in the bore of the blowout preventer is achieved. This pressure can be generally approximately 15,000 p.s.i. This large amount a pressure can actually act against the shear rams so as to further restrict the ability of the shear rams to carry out the necessary shearing of the pipe.

Blowout preventer systems are known to contain the shear rams. These are major pieces of capital equipment that are placed on the ocean floor in order to provide a conduit for the drill pipe and drilling mud while, the same time, providing pressure protection while drilling holes deep into the earth. The typical blowout preventer has an 18¾ inch bore and operates at working pressures of between 10,000 and 15,000 p.s.i. The blowout preventer is often divided into a lower blowout preventer stack and a lower marine riser package.

The lower blowout preventer stack includes a connector for connecting to the wellhead and contains several individual ram-type blowout preventer assemblies which close on various pipe sizes and will close on an open hole through the use of blind rams. The lower marine riser package typically includes a connector at its base for connecting to the top of the lower blowout preventer stack. This contains a single annular preventer for closing any piece of pipe or to close off the open hole. The purpose of the separation between the lower preventer stack and the lower marine riser package is that the annular blowout preventer on the lower marine riser package is the most preferred pressure control assembly. When it experiences a failure or is worn out, it can be released and retrieved to the surface for servicing while the lower blowout preventer stack maintains pressure competency at the wellhead.

Blowout preventers are operated or closed in response to a signal from the surface to a control valve which directs fluid stored in the accumulator bottles to operating cylinders on the blowout preventer. These pressure regulators are set to require a large supply of fluid. Any number of events can prevent the sequence from occurring, such as the failure of the control signals to send the signal, the failure in the connecting lines from the surface, the failure of the valves to close, or the absence of fluid stored under pressure.

When there is a complete failure, it is necessary to have an emergency operation the multiple components in the subsea blowout preventer. A single component, i.e. the blind shear rams can immediately secure an uncontrolled flow of oil or gas from the well. A flat faced gate from each side will meet at the middle in order to seal off the bore. If the pipe is in the bore at the time, it will simply shear the pipe in half and then seal. The blind shear ram is the ultimate safety device, but it must operate. Unfortunately, such rams are not always effective in shearing every type of pipe and are usually limited to the shearing of smaller drill pipe.

High-strength material can adversely affect the ability of such blind shear rams to carry out their intended operation. In other circumstances, there will be other items such as drills, collars, and other items located within the drill pipe. These blind shear rams are often ineffective in cutting through such structures. As such, if such items are positioned in the area of the blind shear rams, there may be a failure in the ultimate final safety mechanism associated with the blowout preventer. As such, need has developed so as to provide further redundancy in connection with the prevention of blowouts.

In the past, various patents have issued relating to devices for the shearing of such pipes. U.S. Pat. No. 3,561,526, issued on Feb. 9, 1971 to Williams, Jr. et al., describes a pipe shearing ram assembly for blowout preventers. This pipe shearing ram assembly has a knife blade that is carried by each of a pair of rams of the ram assembly. The knife blades overlap when the rams are closed with the cutting edge of one knife blade passing just below the cutting edge of the other knife blade to shear a pipe string extending through the preventer. Each knife blade engages a seal member on the other ram. When the rams are closed, they form two vertically spaced seals between the engaging faces of the rams.

U.S. Pat. No. 4,132,267, issued on Jan. 2, 1979 the M. R. Jones, discloses a pipe shearing ram assembly for a blowout preventer having a pair of opposed shear blades. A means is provided for moving the shear blades across the pipe opening. A shoulder on one ram is spaced below the shearing plane of the blades. A face seal is mounted in a recess above the shoulder and below the shearing plane. The leading face of the lower blade coacts with the shoulder to bend a sheared pipe section remaining in its path on the shoulder so that there is no pipe or debris between the leading face and the face seal.

U.S. Pat. No. 5,173,770, issued on Jan. 16, 2001 to C. D. Morrill, provides a shear ram for a ram-type blowout preventer. This ram assembly is positioned in opposed cavities in the body of a blowout preventer. The ram assembly includes a first ram and a second ram. The first and second rams are movable in the cavities along a central guideway axis and between an open position to permit passage of a tubular member through the bore and a closed position to shear the tubular member. First and second shear members are mounted on the first and second rams. Each shear member has a pair of shearing portions disposed on opposite sides of a blade axis. The cutting edges are arranged to shear the tubular member.

U.S. Pat. No. 5,244,336, issued on Jun. 12, 2001 to A. J. Cachich, teaches double shearing rams for blowout preventers. The double shearing rams include an upper shear ram and a mating lower shear ram. The upper shear ram includes an upper cutting blade and a lower guide blade vertically spaced to form a cavity therebetween. The cavity is sized to receive the cutting blade of the lower ram in close fitting engagement when the rams are closed. The upper shear ram has a primary cutting-edge formed on its leading edge and a secondary edge vertically and axially displaced from the primary cutting edge.

U.S. Pat. No. 7,234,530, issued on Jun. 26, 2007 the D. D. Gass, shows a ram-type blowout preventer that includes a body, a first ram block positioned within the body and having a first shearing element and a first sealing element, and a second ram block positioned within the body and opposing the first ram block. The second ram block has a second shearing element and a second sealing element. The blowout preventer includes a load intensifying member coupled to the first ram block in which the first ram block in the second ram blocker is configured to close together upon activation of the blowout preventer.

U.S. Pat. No. 8,443,880, issued on May 21, 2013 to D. Jahnke, describes a blowout preventer having shearing blades. The blowout preventer has a ram with a shear blade for the purpose of shearing a tubular member disposed in the blowout preventer. The profile of the shear blade includes a stress concentrator and centering shaped surface. The stress concentrator and the centering shaped surface can be laterally offset from a centerline of ram travel and on opposite sides of the centerline. An opposing second shear blade can have a mirror image of the shear blade profile with the stressful concentrator and the centering shaped surface reversed to the orientation of the first shear blade.

U.S. Pat. No. 8,448,915, issued on May 28, 2013 to B. F. Baugh, discloses a method of providing a motive force for the rams of a blowout preventer as a function of a desired pressure differential across one or more pistons on the blowout preventer when the desired pressure differential is higher than the gauge pressure of the accumulators that supply the pressure. One or more pistons are connected to the rams. The pistons provide a first pressure from accumulators to the distal side of the pistons.

U.S. Pat. No. 8,567,490, issued on Oct. 29, 2013 to D. W. Van Winkle, provides a shear seal blowout preventer that has a knife edge at the shearing edge. The knife edge is inclined to minimize the cutting force required and to leave a clean cut. The knife edge is presented in an opening of the ram.

It is an object of the present invention to provide an apparatus for the shearing of pipe that is effectively able to cut through any thickness of pipe and any materials that may lie within the interior of the pipe.

It is another object of the present invention to provide an apparatus for the shearing of pipe that is able to cut the pipe immediately.

It is another object of the present invention to provide an apparatus for the shearing of pipe that can be used in conjunction with a mudline closure device or in conjunction with a blowout preventer.

It is still further object of the present invention to provide an apparatus for the shearing of pipe that provides redundancy to the shearing rams associated with the blowout preventer.

It still further object of the present invention to provide an apparatus for the shearing of pipe that is easy to implement, easy to use, and relatively inexpensive.

These and other objects and advantages of the present invention will become apparent from a reading of the attached specification and appended claims.

BRIEF SUMMARY OF THE INVENTION

The present invention is an apparatus for the shearing of pipe in a subsea environment. The apparatus of the present invention includes a housing having an interior passageway with a wall extending therearound. This interior passageway is suitable for allowing the pipe to extend therethrough. A shell is positioned in the interior passageway of the housing. The shell has an interior surface suitable for placement adjacent the pipe. A shape charge is positioned in the shell. The shape charge is positioned so as to be directed toward an outer diameter of the pipe.

In the present invention, the shape charge can include a plurality of shape charges that are positioned in the shell so as to be directed toward the outer diameter of the pipe. The plurality of shaped charges extend radially with respect to the interior passageway of the housing. The plurality of shape charges are positioned on a common horizontal plane. An actuator is connected to the shape charge so as to selectively fire the shape charge. The shape charge has an end extending outwardly of the shell. This end of the shape charge is positioned inwardly of the wall of the housing.

The shell is movable between a first position in which the shape charge is spaced from the pipe and a second position in which the shape charge bears against an outer diameter of the pipe. The shell has a bladder on interior thereof. This bladder is inflatable so as to move an inner surface of the shell from the first position to the second position. An accumulator bottle is connected to the bladder so as to selectively introduce fluid into the bladder so as to move the inner surface of the shell from the first position to the second position.

In the present invention, a flow control apparatus, in the nature of a mudline closure device, can be attached to a well head that is affixed to a lower end of the mudline closure device. A blowout preventer can to be connected to an upper end of the mudline closure device. The shell can be contained within the flow control apparatus. Alternatively, the flow control apparatus can be in the nature of a blowout preventer. As such, the shell can be placed at the desired location within the interior passageway of the blowout preventer.

This foregoing Section is intended to describe, with particularity, the preferred embodiment of the present invention. It is understood that modifications to this preferred embodiment can be made within the scope of the present invention. As such, this Section should not be construed as limiting, in any way, of the broad scope of the present invention. The present invention should only be limited by the following claims and their legal equivalents.

DETAILED DESCRIPTION OF THE INVENTION

Figure 1:
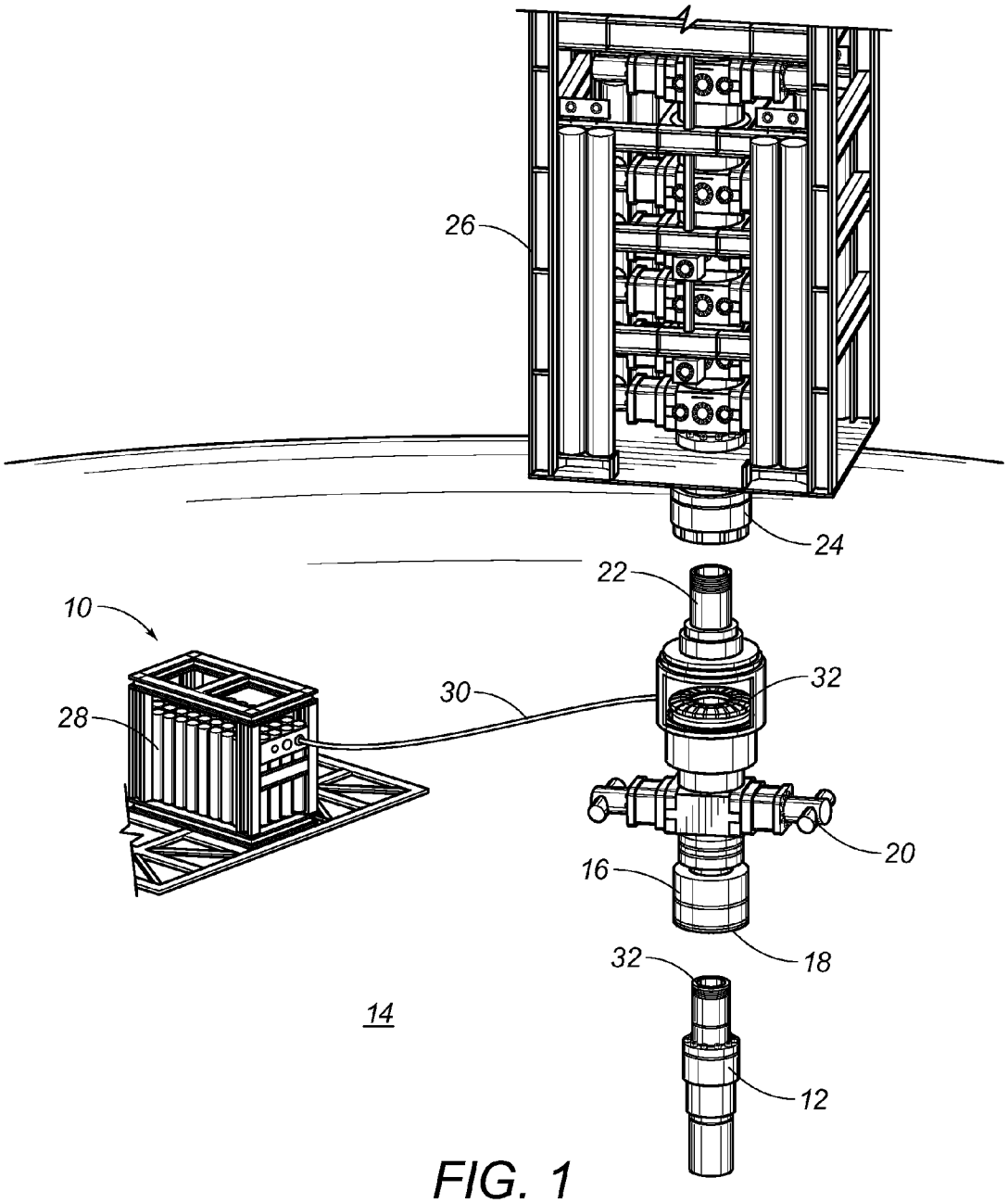
FIG. 1 is an illustration showing the implementation of the apparatus of the present invention in association with a mudline closure device.

In FIG. 1, there shown the system 10 employing the apparatus of the present invention for the shearing of pipe. In FIG. 1, can be seen that there is a wellhead 12 that extends upwardly from a subsea floor 14. A mudline closure device 16 has a lower end 18 that is configured so as to join with the upper end of the wellhead 12. The mudline closure device 16 has a valve 20 therein which can serve to open and close the interior passageway of the mudline closure device 16 upon actuation. The upper end 22 of the mudline closure device 16 extends so as to connect with the lower end 24 of a blowout preventer 26. The blowout preventer 26 is in the nature of a conventional blowout preventer. Accumulator bottles 28 are positioned on the subsea floor 14. The accumulator bottles 28 include a line 30 that is connected to the apparatus 32 of the present invention.

The apparatus 32 is illustrated as placed within the interior passageway of the mudline closure device 16. Conventionally, during offshore oil and gas production activities, a pipe will extend through the blowout preventer 26, through the interior passageway of the mudline closure device 16 and through the wellhead 12. As such, drilling activities can be carried out.

In the event of a failure of the blowout preventer 26, the apparatus 32 of the present invention will fire shape charges so as to effectively cut through the pipe and to shear the pipe and any elements that may be contained within the pipe, such as the drill stem, a drill, a collar, or other structures. As such, the drill pipe will fall through the interior passageway of the mudline closure device 16 and through the interior passageway 32 of the wellhead 12. The valve 20 can then be closed so as to effectively seal the wellhead 12. While the wellhead 12 is sealed, the blowout preventer 26 can be removed for repair and/or replacement. The apparatus 32 of the present invention can be actuated in various ways, such as by acoustic signals.

Figure 2:
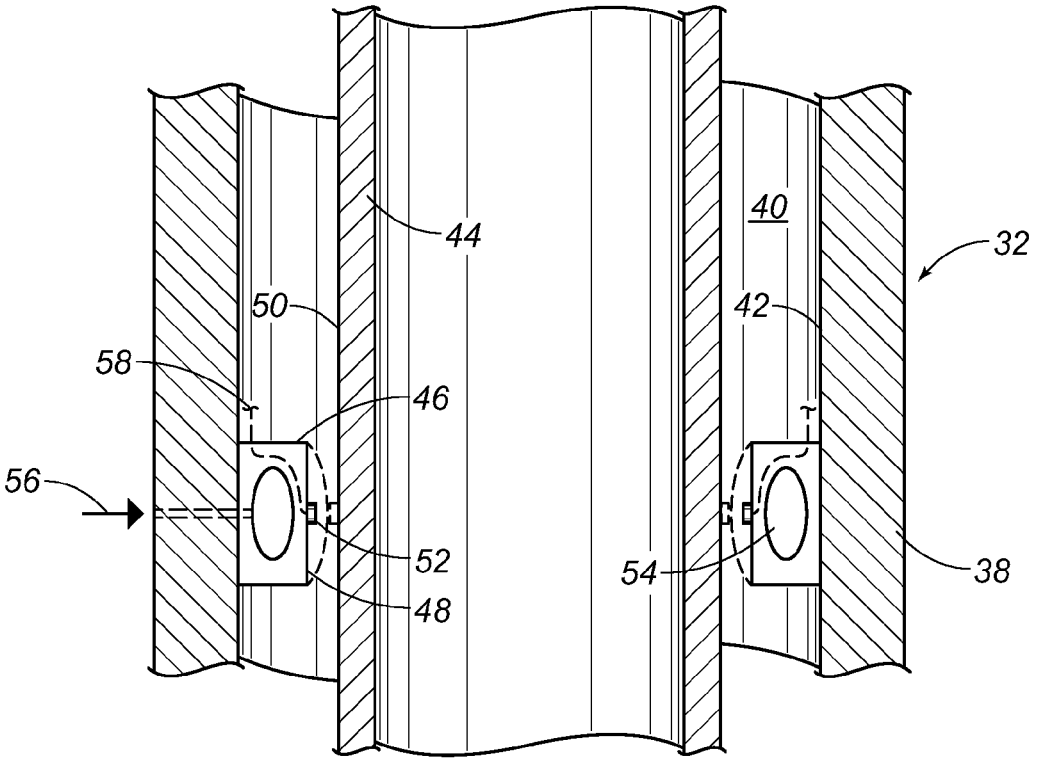
FIG. 2 is a cross-sectional view showing the apparatus of the present invention as movable between a first position and a second position.

FIG. 2 illustrates the configuration of the apparatus 32 of the present invention. In particular, FIG. 2 shows a housing 38 having an interior passageway 40 and a wall 42 extending around the interior passageway 40. The interior passageway 40 is suitable for allowing the pipe 44 to extend therethrough. A shell 46 of an annular configuration is affixed to the wall 42 of the housing 38. The shell 46 has an interior surface 48 suitable for placement adjacent to the outer diameter 50 of the pipe 44. A shape charge 52 is positioned in the shell 46. The shape charge 52 is positioned so as to be directed toward the outer diameter 50 of the pipe 44.

The shape charge is an explosive charge shaped to focus the energy of the explosive. The shape charge can be used to cut through metal. The shape charge employs the Munroe or Newman effect so as to focus the blast energy by a hollow or ovoid cut on a surface of the explosive. The typical shape charge includes a solid cylinder of explosive with a metal-lined outlined conical hollow in one end and a central detonator, an array of detonators, or a detonation wave guide at the other end. Explosive energy is released directly away from the surface of the explosive such that the shaping of the explosive will concentrate the explosive energy in the void. With the enormous pressure generated by the detonation of the explosive drives the liner in the hollow cavity inward to collapse upon its central axis. The resulting collision forms and projects a high-velocity jet of metal particles forward along the axis. As such, the shape charge is extremely effective in emitting a plasma blast for the purpose of shearing the pipe 44.

In FIG. 2, it can be seen that there is a bladder 54 formed within the interior of the shell 46. The accumulator (indicated by arrow 56) is connected to the bladder so as to provide hydraulic fluid into the bladder 54. Since it is desired that the shape charge 52 be placed adjacent to the surface to be cut, the hydraulic fluid will inflate the bladder 54 so as to cause the inner surface 48 of the shell 46 to deflect outwardly such that the shape charge 52 contacts the outer diameter 50 of the pipe 44. A detonation line 58 is illustrated as being connected to the shape charge 52. Detonation line 58 can be suitable for receiving an acoustic signal for the purposes of detonating. As such, a transmitter can be lowered into the body of water so as to send the acoustic signal for the detonation of the shape charge 52. It should be noted that various known techniques can be utilized so as to connect the accumulator bottles 28 to the bladder 54 of the shell 46.

Figure 3:
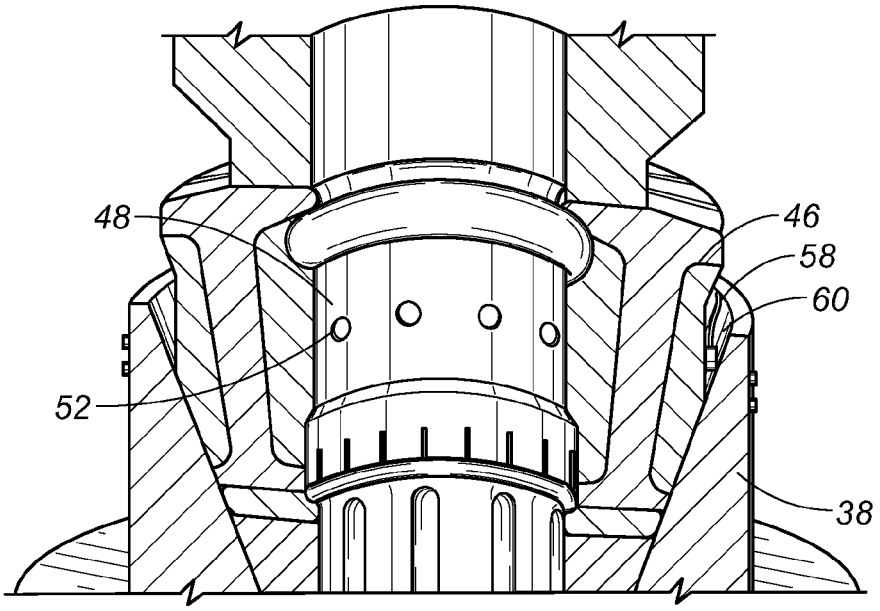
FIG. 3 is a cross-sectional view showing the placement of the shell within the housing and the orientation of the shape charge within the shell.

FIG. 3 illustrates the positioning of the shell 46 within the housing 38. It can be seen that there are a plurality of shape charges 52 positioned on the inner wall inner surface 48 of the shell 46. These shape charges 52 extend radially through the shell 46. The plurality of shape charges 52 extend in a common horizontal plane. As such, the cutting forces will be directed completely around the pipe 44.

The shell 38 is illustrated as having a portion 60 in which there is a space between the outer surface of the shell 46 and the inner wall 42 of the housing 38. This allows the detonator line 58 to extend outwardly therefrom. The shell 46 can be made of a suitable polymeric or elastomeric material so as to be tightly fitted against the inner wall 42 of the housing 38.

Figure 4:
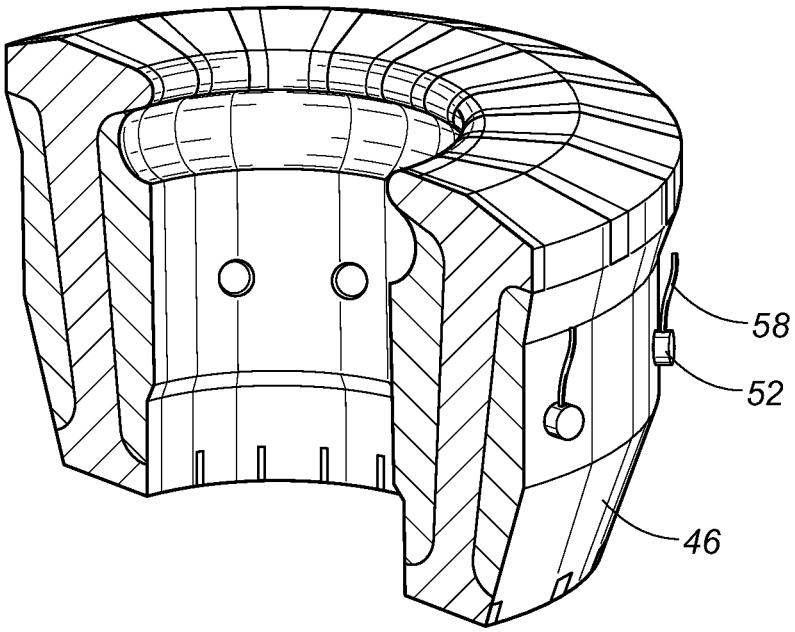
FIG. 4 is an isolated perspective view of a portion of the shell as used in the apparatus of the present invention.

FIG. 4 is another view showing the shell 46 having the shape charges 52 extending therethrough. The detonation line 58 is illustrated as extending outwardly of each of the shape charges 52. As such, the detonation line 58 is suitable for receiving the appropriate acoustic or electrical signal such that the shape charge 52 can be properly detonated for the shearing of pipe.

The present invention provides a very effective method so as to assure that any pipe and other materials that are located within the interior of the wellhead are effectively sheared. If the shearing ram of the blowout preventer is ineffective for cutting through the pipe, then the shape charges 52 associated with the present invention are extremely effective, as a redundant technique, so as to assure that the pipe is properly cut. The explosive nature of the shape charges assures that all materials are sheared. As such, the pipe, and the other equipment, can fall into the hole. The items located above the housing can be removed for repair or replacement. The valve of the mudline closure device can be close so as to assure that the well is sealed.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus for the shearing of pipe in a subsea environment, the apparatus comprising:

a housing having an interior passageway with a wall extending therearound, the interior passageway suitable for allowing the pipe to extend therethrough;

a shell positioned in said interior passageway of said housing, said shell having an interior surface suitable for placement adjacent the pipe; and a shape charge positioned in said shell, said shape charge positioned so as to be directed toward an outer diameter of the pipe, said shell movable between a first position in which said shape charge is spaced from the pipe and a second position in which said shape charge bears against an outer diameter of the pipe; said shell having a bladder on a interior thereof, said bladder being inflatable so as to move said interior surface of said shell from said first position to said second position.

2. The apparatus of claim 1, said shaped charge comprising a plurality of shape charges positioned in said shell so as to be directed toward an outer diameter of the pipe.

3. The apparatus of claim 2, said plurality of shape charges positioned in said shell so as to extend radially with respect to said interior passageway of said housing.

4. The apparatus of claim 3, said plurality of shape charges positioned on a common horizontal plane.

5. The apparatus of claim 1, said shape charge having an end extending outwardly of said shell, said end of said shape charge positioned inwardly of said wall of said housing.

6. The apparatus of claim 1, further comprising:

an accumulator bottle connected to said bladder so as to selectively introduce fluid within said bladder so as to move said inner surface of said shell from said first position to said second position.

7. An apparatus comprising:

a flow control apparatus having an interior passageway, a pipe extending through said interior passageway of said flow control apparatus;

a shell positioned in said interior passageway of said housing, said shell having an interior surface suitable for placement adjacent said pipe; and a shape charge positioned in said shell, said shape charge positioned so as to be directed toward an outer diameter of said pipe, said shell being movable between a first position in which said shape charge is spaced from said pipe and a second position in which said shape charge bears against an outer diameter of said pipe; said shell having a bladder on an interior thereof, said bladder being inflatable so as to move said interior surface from said first position to said second position.

8. The apparatus of claim 7, said flow control apparatus being a mudline closure device, the apparatus further comprising:

a wellhead affixed to a lower end of said mudline closure device; and a blowout preventer connected to an upper end of said mudline closure device.

9. The apparatus of claim 8, said mudline closure device having a valve positioned below said shell, said valve movable between an open position and a closed position, said open position allowing fluids to flow through said interior passageway from said wellhead, said closed position blocking fluid from passing through said interior passageway of said wellhead.

10. The apparatus of claim 7, said shape charge comprising a plurality of shape charges positioned in said shell so as to be directed toward an outer diameter of said pipe.

11. The apparatus of claim 10, said plurality of shape charges positioned in said shell so as to extend radially with respect to said interior passageway of said housing.

12. The apparatus of claim 11, said plurality of shape charges positioned on a common horizontal plane.

13. The apparatus of claim 7, further comprising:

an accumulator bottle connected to said bladder so as to selectively introduce fluid into said bladder so as to move said inner surface of said shell from said first position to said second position.

14. The apparatus of claim 7, said flow control apparatus comprising a blowout preventer.

* * * * *